US006606880B1

(12) United States Patent
Carlin et al.

(10) Patent No.: US 6,606,880 B1
(45) Date of Patent: Aug. 19, 2003

(54) INFLATABLE CONTAINER

(75) Inventors: Glenn Carlin, Kent, CT (US); Gil Aviles, Accord, NY (US)

(73) Assignee: Crew Design Incorporated, Kent, CT (US)

( * ) Notice: Subject to any disclaimer, the term of this patent is extended or adjusted under 35 U.S.C. 154(b) by 0 days.

(21) Appl. No.: 10/077,203

(22) Filed: Feb. 15, 2002

(51) Int. Cl.[7] ..... F25D 3/08
(52) U.S. Cl. ..... 62/457.2; 62/462
(58) Field of Search ..... 62/457.2, 457.5, 62/462, 464, 371, 372, 453, 530; 206/522; 220/592.16, 666

(56) References Cited

U.S. PATENT DOCUMENTS

| | | | | |
|---|---|---|---|---|
| 4,085,785 A | | 4/1978 | Hoot | 150/5 |
| 4,092,750 A | | 6/1978 | Ellis | 5/343 |
| 4,612,781 A | | 9/1986 | Swerdon | 62/457 |
| 4,809,352 A | | 2/1989 | Walker | 383/3 |
| D333,592 S | | 3/1993 | Walker | D7/605 |
| 5,353,607 A | * | 10/1994 | McBride | 62/457.7 |
| 5,622,261 A | | 4/1997 | Mobley et al. | 206/457 |
| 5,967,390 A | * | 10/1999 | Goryl | 224/153 |
| 6,123,217 A | | 9/2000 | Miller | 220/592 |
| D440,119 S | | 4/2001 | Peterson | D7/605 |
| D440,120 S | | 4/2001 | Peterson | D7/605 |
| D440,122 S | | 4/2001 | Peterson | D7/605 |
| D443,182 S | | 6/2001 | Peterson | D7/605 |
| 6,442,962 B1 | * | 9/2002 | Gaetke et al. | 62/457.6 |

OTHER PUBLICATIONS

Front Cover of "Creative" Magazine, publication Apr./May 2001.

Copies of two pages of advertisements for "Inflatables" by Sterling (updated).

Copy of advertisement entitled "Blow It Up" by Alvimar Inflatables (undated).

Copy of advertisement entitled "Inflatable Displays & Premiums" by Creations Inc. (undated).

Pp. 114 and 115 from "Inflatable Promotions '2001" by Creative (undated).

* cited by examiner

*Primary Examiner*—Chen Wen Jiang
(74) *Attorney, Agent, or Firm*—McCormick, Paulding & Huber LLP

(57) ABSTRACT

An inflatable container comprises a support wall defining a storage cavity. The support wall includes a flexible material forming at least one air chamber that when full of air or other gas forms a structure for holding ice and other material received within the storage cavity of the support wall. A drainage compartment communicates with a generally lower portion of and is disposed external to the storage cavity defined by the support wall for drawing melted ice away from the storage cavity and into the drainage compartment.

15 Claims, 2 Drawing Sheets

INFLATABLE CONTAINER

FIELD OF THE INVENTION

This invention relates generally to an inflatable device, and more particularly to an inflatable container or cooler for holding ice and products such as beverages to be cooled therefrom, the container including a peripheral component for drawing away and capturing melted water so as to prevent water from remaining within the container enclosure.

BACKGROUND OF THE INVENTION

Inflatable or foam-filled devices for advertising products are becoming increasingly popular in stores and in magazines for advertising products. These devices are typically enlarged representations of the products which they are advertising with respect to shape or logo printed or otherwise affixed to the advertising device. It has been discovered that an enlarged inflatable advertising device can also serve as a storage container for products to be sold. For example, these containers can hold beverages in a bed of ice so that the beverages are ready to drink when removed from the container and thereafter purchased. A drawback with such containers is that the melted ice within the containers can pose a hazard should the container leak or otherwise be damaged. This problem is especially acute in states where laws prevent water from accumulating in such containers.

In view of the foregoing, it is a general object of the present invention to provide an inflatable container that avoids the above-described drawbacks of prior inflatable containers.

SUMMARY OF THE INVENTION

In one aspect of the present invention, an inflatable container comprises a support wall defining a storage cavity. The support wall includes a flexible material forming at least one air chamber that when full of air or other gas forms a structure for holding ice and other material received within the storage cavity of the support wall. Provision is made for draining melted ice from the storage cavity. Preferably, a drainage compartment communicates with a generally lower portion of and is disposed external to the storage cavity defined by the support wall for drawing melted ice away from the storage cavity and into the drainage compartment.

In a second aspect of the present invention, an inflatable container comprises a base and at least one sidewall coupled at one end to the base to form a storage cavity. The sidewall includes a flexible material forming at least one inflatable air chamber that when inflated with air or other gas forms a support structure for holding ice and other material received within the storage cavity. A drainage compartment communicates with a generally lower portion of and is disposed external to the storage cavity defined by the base and the sidewall for drawing melted ice away from the storage cavity and into the drainage compartment.

In a third aspect of the present invention, an inflatable container comprises a base including a flexible material forming at least one air chamber including a valve that when open permits air or other gas to pass therethrough for inflating or collapsing the base, and that when closed permits the base to be maintained in an inflated state. At least one sidewall is coupled at one end to the base such that the base and the sidewall form a storage cavity. The sidewall includes a flexible material forming at least one air chamber including a valve that when open permits air or other gas to pass therethrough for inflating or collapsing the sidewall, and that when closed permits the sidewall to be maintained in an inflated state. The base and the sidewall when inflated form a support structure for holding ice and other material received within the storage cavity. A bladder is generally disposed external to the storage cavity defined by the base and the sidewall, and communicates via a conduit with a generally lower portion of the storage cavity for drawing melted ice away from the storage cavity and into the bladder.

An advantage of the present invention is that the inflatable container prevents melted ice from accumulating within its interior cavity and thereby posing the threat of leaking water.

These and other advantages of the present invention will become more apparent in the light of the following detailed description and accompanying figures.

DETAILED DESCRIPTION OF THE PREFERRED EMBODIMENTS

Figure 1:
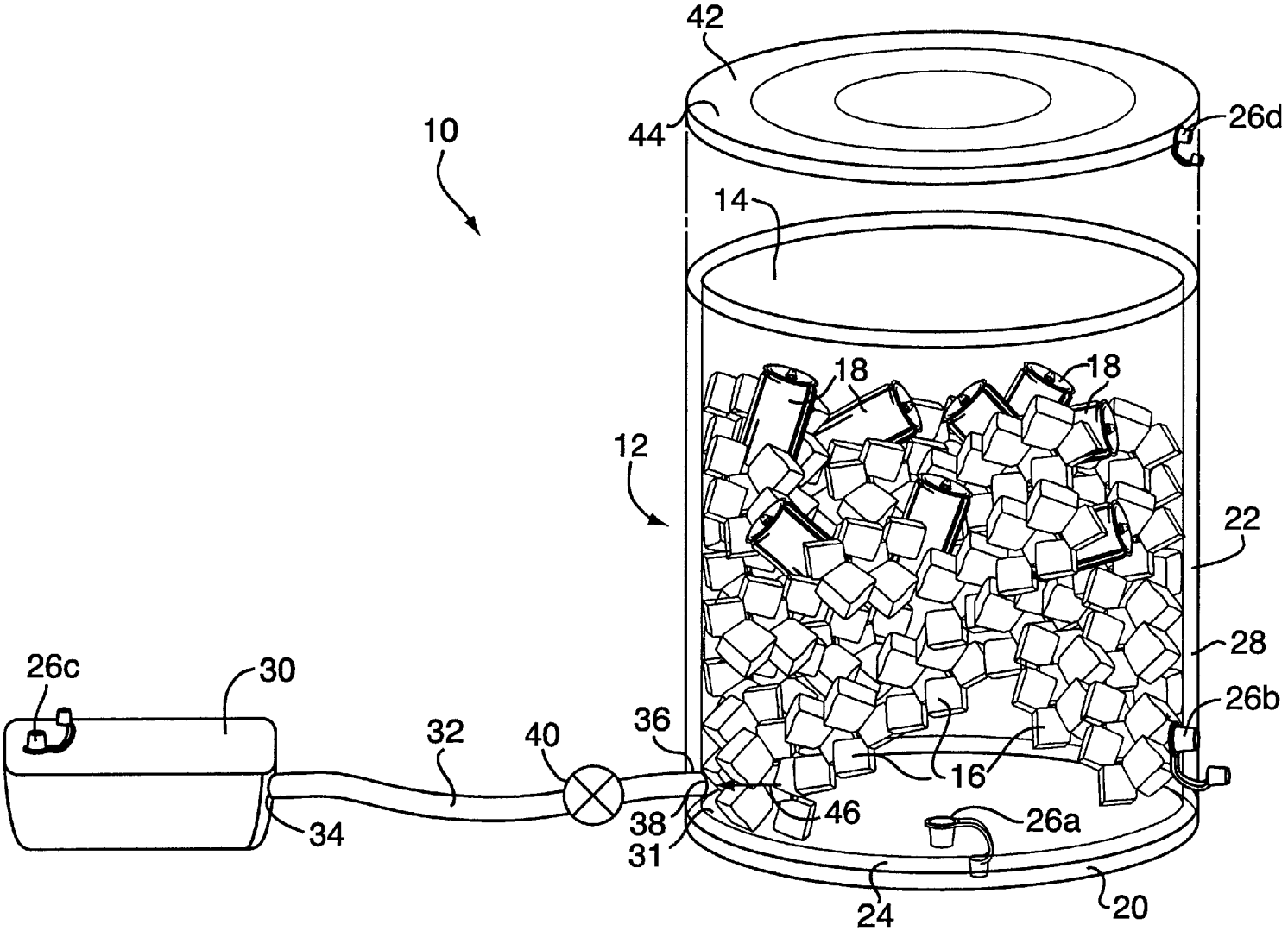
FIG. 1 is a perspective view of a container in an inflated state in accordance with the present invention.
Figure 2:
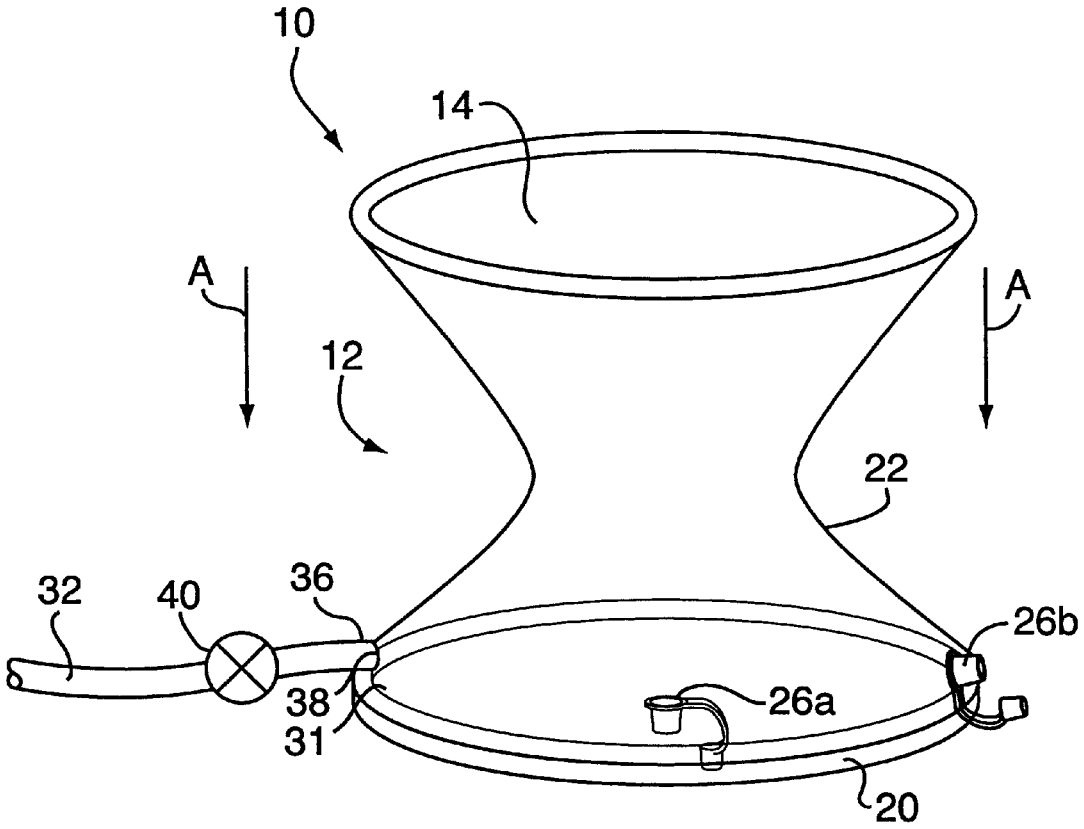
FIG. 2 is a perspective view of the container of FIG. 1 in a collapsed state.
Figure 3:
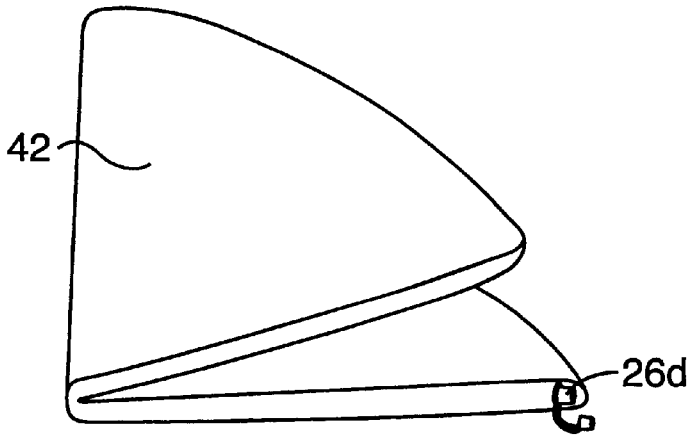
FIG. 3 is a perspective view of the cover of the container in a collapsed state.

With reference to FIGS. 1–3, an inflatable container embodying the present invention is generally designated by the reference number 10. The container 10 comprises a support wall 12 defining a storage cavity 14 for holding, for example as shown in FIG. 1, ice 16 and other products 18 for display, such as cans or bottles of soda, as well as other products which preferably should be cooled for consumption or other purposes. The support wall 12 preferably includes a generally circular base 20 and a generally cylindrical sidewall 22. However, it should be understood that the support wall 12 may include one or more components and have other shapes without departing from the scope of the present invention. For example, the support wall 12 may be a single piece in the form of a concave bowl, or may comprise several components or pieces such as a base and four sidewalls to form a square or rectangular container. The support wall 12 includes a flexible material, such as but not limited to plastic or rubber, so as to be inflatable for use and collapsible for storage as will be more fully explained.

As shown in FIGS. 1 and 2, the base 20 includes an air chamber 24 including a valve 26*a* that when open permits air or other gas to pass therethrough into or out of the air chamber 24 for respectively inflating or collapsing the base, and that when closed permits the base to be maintained in an inflated state. Similarly, the sidewall 22 includes an air chamber 28 including a valve 26*b* for the passage of air or other gas therethrough into or out of the air chamber 28 to respectively inflate (see FIG. 1) or collapse (see FIG. 2) the sidewall. The air chamber 24 associated with the base 20, and the air chamber 28 associated with the sidewall 22 are preferably separate and independent of one another for ease of fabrication and to permit one of the air chambers to remain inflated should the other air chamber leak or otherwise be damaged. Although the base 20 is shown and described as being inflatable, it should be understood that the base may be substantially rigid without departing from the scope of the present invention.

With reference to FIG. 1, the inflatable container 10 further comprises means for draining water from the storage cavity 14, such as, for example, a drainage compartment 30. The drainage compartment 30 may be in the form of a bladder fabricated from a flexible material such as plastic, for drawing away from the storage cavity 14 and into the drainage compartment melted ice accumulating therein as will be more fully explained. It should be understood that the drainage compartment 30 may have other forms without departing from the scope of the present invention. For example, the drainage compartment 30 may be a generally rigid and watertight enclosure.

The drainage compartment 30 fluidly communicates with a generally lower portion 31 of the storage cavity 14 via, for example, a conduit 32 having a first end 34 coupled to the drainage compartment 30 and a second end 36 coupled to an opening 38 defined in the lower portion 31 of the storage cavity 14. Preferably, the conduit 32 is fabricated from a flexible material such as, but not limited to, plastic or rubber for adjustable placement of the drainage compartment 30 relative to the storage cavity 14. A valve 40 is preferably interposed between the first end 34 and the second end 36 of the conduit 32 for regulating the flow of fluid from the storage cavity 14 to the drainage compartment 30. Further, the drainage compartment 30 preferably includes a valve 26*c* that when open provides for emptying fluid from the drainage compartment.

With reference to FIGS. 1 and 3, the container 10 may include a cover 42 for enclosing the storage cavity 14 defined by the base 20 and the sidewall 22. Preferably, the cover 42 includes a flexible material, such as but not limited to plastic or rubber, forming an air chamber 44 including a valve 26*d* that when open permits air or other gas to pass therethrough into or out of the air chamber 44 to respectively inflate the cover for use (see FIG. 1) or collapse the cover for storage (see FIG. 3), and that when closed permits the cover to be maintained in an inflated state. Although the cover 42 is shown and described as being inflatable, it should be understood that the cover may be substantially rigid without departing from the scope of the present invention.

In operation, the container 10 including the support wall 12 and the cover 42 can each when in a collapsed state be folded into a desired form such as, for example, be folded one or more times upon itself so as to be in compact form for storage or transport. As shown in FIG. 2, for example, a top end of the sidewall 22 can be collapsed in the direction of the arrows A toward the base 20 by squeezing or otherwise forcing air out of the air chambers 28 and 24 when the respective valves 26*a* and 26*b* associated with the air chambers for the sidewall and the base are open. As shown in FIG. 3, the cover 42 can be folded into a compact form, such as into quarters, by squeezing or otherwise forcing air out of the air chamber 44 when the valve 26*d* associated with the cover is open.

The container 10 may thereafter be transformed into usable form by pumping or otherwise forcing air into the air chambers 24, 28 and 44 of the base 20, the sidewall 22 and the cover 42, respectively. The valves 26*a*, 26*b* and 26*d* respectively associated with the base 20, the sidewall 22 and the cover 42 are then closed to maintain the base, the sidewall and the cover in an inflated state.

Once the container 10 is in an inflated or usable form, the storage cavity 14 may be filled with material. For example, the storage cavity 14 may be filled with ice 16 and beverages 18 to be kept cool for purchase and subsequent consumption. As the ice 16 melts within the storage cavity 14, melted ice or water 46 sinks to the lower portion 31 of the storage cavity 14 where it is drawn by water pressure through the conduit 32 away from the storage cavity 14 and into the drainage compartment 30. The drainage compartment 30 may be located at a suitable place such as over a permanent drain where collected water may be evacuated.

Although the invention has been shown and described in preferred embodiments, it should be understood that numerous modifications can be made without departing from the spirit and scope of the present invention. For example, the base 20, the sidewall 22 and the cover 42 may each include several air chambers to further protect the container 10 from losing its shape should one of the air chambers leak or otherwise be damaged. Accordingly, the present invention has been shown and described by way of illustration rather than limitation.

What is claimed is:

1. An inflatable container comprising:

a support wall defining a storage cavity and including a flexible material forming at least one air chamber that when full of air or other gas forms a structure for holding ice and other material received within the storage cavity of the support wall;

a drainage compartment including a bladder for communicating with a generally lower portion of and disposed external to the storage cavity defined by the support wall for drawing melted ice away from the storage cavity and into the drainage compartment;

a conduit having a first end communicating with a generally lower part of the storage cavity of the support wall, and a second end communicating with the drainage compartment; and a valve interposed between the first end and the second end of the conduit for regulating the flow of fluid from the storage cavity of the support wall to the drainage compartment.

2. An inflatable container as defined in claim 1, wherein the at least one air chamber of the support wall includes a valve that when open permits air or other gas to pass therethrough for inflating or collapsing the support wall, and that when closed permits the support wall to be maintained in an inflated state.

3. An inflatable container as defined in claim 1, wherein the drainage compartment includes a valve for emptying fluid from the drainage compartment.

4. An inflatable container as defined in claim 1, wherein the conduit is generally of a flexible material.

5. An inflatable container as defined in claim 1, wherein the support wall includes a base and at least one sidewall coupled at one end to the base, the at least one sidewall including at least one air chamber.

6. An inflatable container as defined in claim 5, wherein the at least one sidewall is generally cylindrical.

7. An inflatable container as defined in claim 5, wherein the base includes at least one air chamber that is independent of the at least one air chamber associated with the at least one sidewall.

8. An inflatable container as defined in claim 1, further including a cover for enclosing the storage cavity defined by the support wall.

9. An inflatable container as defined in claim 8, wherein the cover includes a flexible material forming at least one air chamber.

10. An inflatable container as defined in claim 9, wherein the at least one air chamber of the cover includes a valve that when open permits air or other gas to pass therethrough for inflating or collapsing the cover, and that when closed permits the cover to be maintained in an inflated state.

11. An inflatable container comprising:

a base and at least one sidewall coupled at one end to the base to form a storage cavity, the at least one sidewall including a flexible material forming at least one inflatable air chamber that when inflated with air or other gas forms a support structure for holding ice and other material received within the storage cavity;

a drainage compartment including a bladder for communicating with a generally lower portion of and disposed external to the storage cavity defined by the base and the at least one sidewall for drawing melted ice away from the storage cavity and into the drainage compartment;

a conduit having a first end communicating with a generally lower part of the storage cavity, and a second end communicating with the drainage compartment; and a valve interposed between the first end and the second end of the conduit for regulating the flow of fluid from the storage cavity of the support wall to the drainage compartment.

12. An inflatable container as defined in claim 11, wherein the base includes a flexible material forming an inflatable air chamber.

13. An inflatable container as defined in claim 11, further including an inflatable cover for enclosing the storage cavity defined by the base and the at least one sidewall.

14. An inflatable container comprising:

a base including a flexible material forming at least one air chamber, the air chamber including a valve that when open permits air or other gas to pass therethrough for inflating or collapsing the base, and that when closed permits the base to be maintained in an inflated state;

at least one sidewall coupled at one end to the base such that the base and the at least one sidewall form a storage cavity, the at least one sidewall including a flexible material forming at least one air chamber including a valve that when open permits air or other gas to pass therethrough for inflating or collapsing the at least one sidewall, and that when closed permits the at least one sidewall to be maintained in an inflated state, the base and the at least one sidewall when inflated forming a support structure for holding ice and other material received within the storage cavity;

a bladder generally disposed external to the storage cavity defined by the base and the at least one sidewall, and communicating via a conduit with a generally lower portion of the storage cavity for drawing melted ice away from the storage cavity and into the bladder; and a valve interposed between the first end and the second end of the conduit for regulating the flow of fluid from the storage cavity of the support wall to the drainage compartment.

15. An inflatable container as defined in claim 14, further including an inflatable cover for enclosing the storage cavity defined by the base and the at least one sidewall.

* * * * *